US009115528B2

(12) United States Patent
Hellbusch et al.

(10) Patent No.: US 9,115,528 B2
(45) Date of Patent: Aug. 25, 2015

(54) VEHICLE DOOR CONTROL SYSTEM AND METHOD

(75) Inventors: Ingo Hellbusch, Springe (DE); Uwe Stabenow, Laatzen (DE)

(73) Assignee: WABCO GmbH, Hannover (DE)

( * ) Notice: Subject to any disclaimer, the term of this patent is extended or adjusted under 35 U.S.C. 154(b) by 365 days.

(21) Appl. No.: 13/821,829

(22) PCT Filed: Jun. 10, 2011

(86) PCT No.: PCT/EP2011/002853
§ 371 (c)(1),
(2), (4) Date: Mar. 8, 2013

(87) PCT Pub. No.: WO2012/034610
PCT Pub. Date: Mar. 22, 2012

(65) Prior Publication Data

US 2013/0167519 A1 Jul. 4, 2013

(30) Foreign Application Priority Data

Sep. 14, 2010 (DE) ..... 10 2010 045 337

(51) Int. Cl.
*E05F 15/02* (2006.01)
*E05F 15/50* (2015.01)

(52) U.S. Cl.
CPC ..... *E05F 15/02* (2013.01); *E05F 15/50* (2015.01); *E05Y 2900/531* (2013.01)

(58) Field of Classification Search
CPC ..... E05F 15/02; E05F 15/50
USPC ..... 60/413, 412, 407, 453
See application file for complete search history.

(56) References Cited

U.S. PATENT DOCUMENTS

| | | | | |
|---|---|---|---|---|
| 3,936,977 | A | 2/1976 | Runft et al. | |
| 4,523,513 | A * | 6/1985 | Gudat et al. | 91/427 |
| 6,752,402 | B2 * | 6/2004 | Grotendorst et al. | 280/6.152 |

FOREIGN PATENT DOCUMENTS

| | | |
|---|---|---|
| DE | 3308547 | 9/1984 |
| DE | 10038266 | 2/2002 |
| DE | 20318899 | 5/2005 |
| DE | 10 2008 011315 | 9/2009 |
| EP | 0520166 | 12/1992 |
| EP | 520166 A1 * | 12/1992 |

* cited by examiner

*Primary Examiner* — Thomas E Lazo
(74) *Attorney, Agent, or Firm* — Kramer Levin Naftalis & Frankel LLP

(57) ABSTRACT

A door control system for a vehicle includes a compressor, an air dryer, a door control valve and at least one cylinder that can be actuated by compressed air. A piston of the cylinder can occupy a first functional position and a second functional position. The air dryer, in drying mode, is exposed to throughflow of the air flowing into the cylinder, and in regeneration mode is exposed to throughflow by the air discharging from the cylinder. The cylinder is pressurized only with compressed air from a compressed air accumulator.

10 Claims, 1 Drawing Sheet

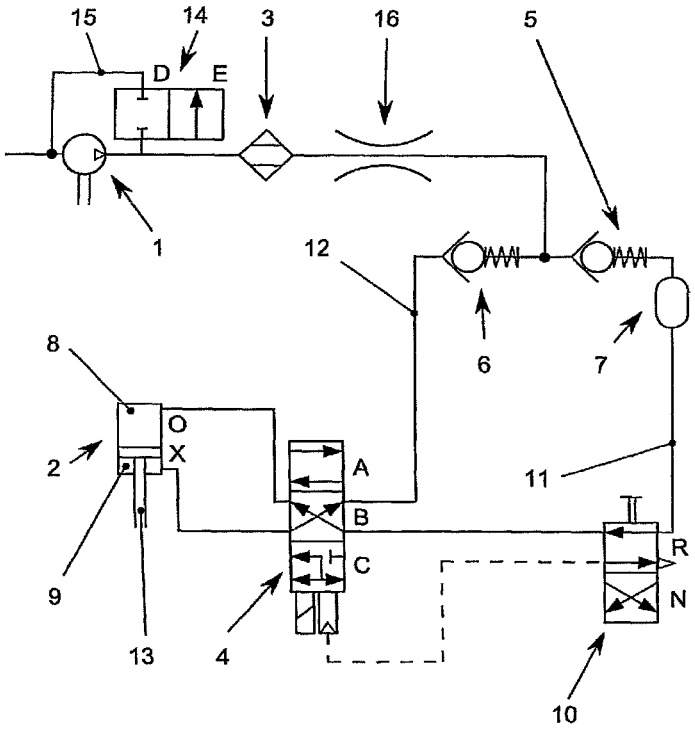
15
14
3
16
5
D
E
1
12
6
7
8
O
X
2
A
B
C
11
R
N
9
13
4
10

VEHICLE DOOR CONTROL SYSTEM AND METHOD

FIELD OF THE INVENTION

The present invention generally relates to a pneumatic door control system and method for vehicles.

BACKGROUND OF THE INVENTION

DE 10 2008 011 315 A1 describes a pneumatic vehicle door control system with a double-acting cylinder, which is connected to the vehicle door, the two cylinder chambers of which are connected to the compressor via valves. When the cylinder is being ventilated, the compressed air is relieved into the atmosphere.

As a rule, moisture is extracted from the compressed air, which is produced by a compressor, in an air dryer since dry compressed air has higher quality, which has, inter alia, a positive effect on the service life of the pneumatic system. Such an air dryer must be periodically manually drained and/or regenerated by means of additionally supplied heat. In the event of failure of the regeneration devices or interruption or incorrect performing of maintenance, there is the risk of icing of the system.

SUMMARY OF THE INVENTION

Generally speaking, it is an object of the present invention to provide an improved door control system that is energy efficient and reliable.

According to an embodiment of the present invention, a device is provided in which a cylinder, by means of a door control valve, can be connected via a first flow path to an air dryer and to a compressor for filling, and can be connected via a second flow path to the air dryer and to atmosphere for emptying. In this case, the air dryer can be operated in drying mode when the cylinder is being filled and operated in regeneration mode when the cylinder is being emptied. In drying mode, the air dryer is exposed to throughflow of air flowing into the cylinder, and in regeneration mode, is exposed to throughflow of air flowing out of the cylinder. As a result, during each operation of the vehicle door, that is, during each cylinder cycle, the ventilated air flows through the air dryer, absorbs moisture there, and discharges this to atmosphere. The air dryer is therefore regenerated during each cylinder cycle, as a result of which maintenance intervals can be reduced to a minimum or completely dispensed with since the air dryer no longer has to be drained manually. Also, there is no risk of icing of the pneumatic system.

It is favorable that the first flow path and the second flow path are disconnected from each other by means of a cylinder-side check valve and an accumulator-side check valve. As a result, the routing of air in the door control system, especially the flow of air through the first flow path and the second flow path, is correctly carried out.

Advantageously, a compressed air accumulator is provided in the first flow path between the air dryer and the door control valve downstream of the accumulator-side check valve. The compressed air accumulator receives compressed air from the compressor and delivers compressed air to the cylinder. The compressed air received by the compressed air accumulator has been dried beforehand in the air dryer, which is operated in drying mode. The arrangement of the compressed air accumulator in the first flow path makes it possible, on the one hand, for the compressed air accumulator, as a reservoir, to receive sufficient compressed air for a plurality of cylinder cycles and therefore for the compressor to be dimensioned with lower power consumption and also smaller overall size with the capability of being operated almost continuously. A compressor that is optimized as a result of the low power consumption of the engine and a low mass contributes to a low energy demand of the vehicle. On the other hand, this arrangement makes it possible for ventilation to be carried out quickly and therefore for speedy door operation to be achieved.

It is advantageous that the compressor can be bypassed by means of a vent valve. As a result, it is possible that no air flow has to pass through the compressor when the cylinder is being emptied, as a result of which fast emptying is ensured.

As the cylinder for operating the vehicle door, a cylinder with only one chamber can be provided. Preferably, a double-acting cylinder with two chambers is used. In this case, it is favorable that one of the two cylinder chambers can be connected to atmosphere via the door control valve, and the other of the two cylinder chambers can be connected to the compressed air accumulator via the door control valve, or that both cylinder chambers can be connected to the compressed air accumulator and/or to atmosphere via the door control valve.

According to an embodiment of a control method, the door control valve is actuated for switching between the first functional position and the second functional position of the piston of the cylinder, wherein the compressed air flows from the first cylinder chamber or from the second cylinder chamber for venting to atmosphere, and the other of the first cylinder chamber or the second cylinder chamber is filled with compressed air from the compressed air accumulator. The air discharged from the one cylinder chamber makes its way via a second flow path, via the cylinder-side check valve, to the air dryer, which is exposed to throughflow of the discharging air and is regenerated in the process. The discharging air is then finally vented to atmosphere, via a vent valve, via a bypass of the compressor. At the same time, compressed air from a compressed air accumulator, which is arranged in the first flow path between the accumulator-side check valve and the door control valve, flows into the other cylinder chamber via the first flow path.

The cylinder is only pressurized with compressed air from the compressed air accumulator, as a result of which it is possible that the compressor can be dimensioned with lower power consumption and also smaller overall size. The compressed air accumulator, which serves as a reservoir, is used in this case as an energy accumulator and can supply the system with high volumetric flows when required. Moreover, it becomes possible that at the same time the one cylinder chamber is filled, the compressed air from the other cylinder chamber, when being emptied, flows through the air dryer and regenerates it.

It is advantageous that, before the actuation of the door control valve, the vent valve is brought into a ventilating switched position in which a bypass of the compressor is opened. As a result, it becomes possible that during the actuation of the door control valve a lower pressure prevails in the second flow path than in the first flow path. Therefore, in combination with the check valves it is ensured that when the cylinder is being emptied the discharging air does not escape again into the compressed air accumulator but escapes through the air dryer into the atmosphere. Establishing the pressure differential furthermore enables the use of low-maintenance, inexpensive, spring-loaded check valves. In place of check valves, switchable valves can also be used.

It is also favorable that after the cylinder piston has been moved, the vent valve is brought into a compressed-air switched position in which the bypass of the compressor is closed. The compressed air accumulator can then be replenished when required by the compressor being put into operation.

According to another embodiment of the present invention, with actuation of a relief valve for emergency unlocking, the door control valve is brought into a third switched position in which the first cylinder chamber and the second cylinder chamber are connected to atmosphere. As a result, it becomes possible for the vehicle door to be freely movable, only against the frictional resistance of its mounting.

Still other objects and advantages of the present invention will in part be obvious and will in part be apparent from the specification.

The present invention accordingly comprises the features of construction, combination of elements, arrangement of parts, and the various steps and the relation of one or more of such steps with respect to each of the others, all as exemplified in the constructions herein set forth, and the scope of the invention will be indicated in the claims.

BRIEF DESCRIPTION OF THE DRAWINGS

The invention is described in more detail hereinafter with reference to an exemplary embodiment depicted in the appended drawing, in which:

FIG. 1 shows a pneumatic door control system according to an embodiment of the present invention.

DETAILED DESCRIPTION OF THE PREFERRED EMBODIMENTS

FIG. 1 is a schematic of a pneumatic door control system with a compressor 1 for producing compressed air, a cylinder 2 for operating a vehicle door, an air dryer 3 and a door control valve 4. The cylinder 2 has a first chamber 8 and a second chamber 9 that are separated from each other by means of a piston 13, which is movably arranged in the cylinder 2. The cylinder piston 13 can systematically occupy a first functional position O and a second functional position X, wherein the cylinder piston 13 occupies the second functional position X as soon as the first cylinder chamber 8 is pressurized. If the second cylinder chamber 9 is pressurized, then the cylinder piston 13 is in the first functional position O.

A switch between the first functional position O and the second functional position X is achieved by a change of a first switched position A and a second switched position B of the door control valve 4. In FIG. 1, the door control valve 4 is in the second switched position B. Consequently, the first cylinder chamber 8 is connected via a first flow path 11 to the compressed air accumulator 7 and filled with compressed air. The compressed air in the first cylinder chamber 8 exerts a force upon the cylinder piston 13 so that it is moved into the second functional position X and held there.

If the door control valve 4 is actuated, that is, brought into the first switched position A, for example, then the first cylinder chamber 8, which is filled with compressed air, is emptied, and the second cylinder chamber 9 is filled with compressed air. The air escaping from the first cylinder chamber 8 makes its way via the second flow path 12, via a cylinder-side check valve 6, to the air dryer 3. The air dryer 3 is exposed to throughflow by the escaping air and regenerated in the process. The discharging air can then finally be vented to atmosphere via a vent valve 14 in a ventilating switched position E via a bypass 15 of the compressor 1. At the same time, compressed air from a compressed air accumulator 7 flows via the first flow path 11 into the second cylinder chamber 9. In order to prevent inflow of the discharging air into the compressed air accumulator 7, the vent valve 14 is actuated just ahead of the door control valve 4, as a result of which the pressure in the second flow path 12 is lower than in the first flow path 11.

After switching of the cylinder piston between the first functional position O and the second functional position X, the vent valve 14 is, as shown in FIG. 1, brought into the compressed-air switched position D for closing the bypass 15. Compressed air, which is produced by the compressor 1, can now be dried in the air dryer 3 and can flow back into the compressed air accumulator 7 to fill it.

The first flow path 11 is disconnected from the second flow path 12 by means of the cylinder-side check valve 6 and by means of an accumulator-side check valve 5. A restrictor 16 is arranged between the check valves 5, 6 and the air dryer 3.

For emergency unlocking of the vehicle door, a relief valve 10 is provided, which during control actuation is in a control switched position R and for emergency unlocking is set in an emergency switched position N. In the emergency switched position N, the compressed air from the compressed air accumulator 7 sets the door control valve 4 in a third switched position C. This results in the first cylinder chamber 8 and the second cylinder chamber 9 being connected via the relief valve 10 to atmosphere and therefore being in an unpressurized state. If the first cylinder chamber 8 and the second cylinder chamber 9 are in an unpressurized state, the vehicle door can easily be moved by hand.

It will thus be seen that the objects set forth above, among those made apparent from the pr ceding description, are efficiently attained, and since certain changes may be made without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention that, as a matter of language, might be said to fall there-between.

What is claimed is:

1. A door control system for a vehicle, the system comprising a compressor; an air dryer; a door control valve; and at least one cylinder that is actuatable by compressed air, the at least one cylinder being connectable by a door control valve and via a first flow path to an air dryer and to the compressor for filling, and the at least one cylinder being connectable via a second flow path to the air dryer and to atmosphere for emptying.

2. The door control system according to claim 1, wherein the first flow path and the second flow path are disconnected from each other via an accumulator-side check valve and a cylinder-side check valve.

3. The door control system according to claim 2, further comprising a compressed air accumulator configured to receive compressed air from the compressor and to deliver compressed air to the at least one cylinder, the compressed air accumulator being disposed in the first flow path between the air dryer and the door control valve downstream of the accumulator-side check valve.

4. The door control system according to claim 1, further comprising a vent valve configured to bypass the compressor.

5. The door control system according to claim 1, wherein the at least one cylinder is a double-acting cylinder having a first chamber and a second chamber.

6. The door control system according to claim 5, wherein the first chamber and the second chamber are alternately connectable to at least one of the compressed air accumulator and to atmosphere by the door control valve.

7. A method for actuating a cylinder of a vehicle door, the cylinder having a piston that can occupy a first functional position and a second functional position, the method comprising actuating a door control valve and switching the first functional position and the second functional position, venting through an air dryer to atmosphere compressed air from one of a first cylinder chamber and a second cylinder chamber of the cylinder, and filling the other of the first cylinder chamber and the second cylinder chamber with compressed air from a compressed air accumulator.

8. The method according to claim 7, further comprising connecting the first cylinder chamber and the second cylinder chamber to atmosphere when a relief valve is actuated for emergency unlocking.

9. A method for actuating a cylinder of a vehicle door, the cylinder having a piston that can occupy a first functional position and a second functional position, the method comprising actuating a door control valve and switching the first functional position and the second functional position, venting to atmosphere compressed air from one of a first cylinder chamber and a second cylinder chamber, filling the other of the first cylinder chamber and the second cylinder chamber with compressed air from a compressed air accumulator, and placing a vent valve into a ventilating switched position and opening a bypass of a compressor before actuating the door control valve.

10. The method according to claim 9, further comprising placing the vent valve into a compressed-air switched position and closing the bypass of the compressor after switching between the first functional position and the second functional position of the cylinder piston.

* * * * *